US012162118B2

(12) United States Patent
Creeley

(10) Patent No.: US 12,162,118 B2
(45) Date of Patent: Dec. 10, 2024

(54) FLEXIBLE DENSITY SANDING SYSTEM

(71) Applicant: Creeley Patent LLC, Cheektowaga, NY (US)

(72) Inventor: Jacob Creeley, Orchard Park, NY (US)

( * ) Notice: Subject to any disclaimer, the term of this patent is extended or adjusted under 35 U.S.C. 154(b) by 0 days.

(21) Appl. No.: 18/576,095

(22) PCT Filed: Jun. 30, 2022

(86) PCT No.: PCT/US2022/073299
§ 371 (c)(1),
(2) Date: Jan. 2, 2024

(87) PCT Pub. No.: WO2023/279053
PCT Pub. Date: Jan. 5, 2023

(65) Prior Publication Data

US 2024/0261938 A1 Aug. 8, 2024

Related U.S. Application Data

(60) Provisional application No. 63/217,510, filed on Jul. 1, 2021.

(51) Int. Cl.
*B24D 15/04* (2006.01)
*B24D 18/00* (2006.01)

(52) U.S. Cl.
CPC ..... *B24D 15/04* (2013.01); *B24D 18/0009* (2013.01)

(58) Field of Classification Search
CPC ..... B24D 15/04; B24D 18/0009
USPC ..... 451/523, 524, 525, 527, 529, 530, 533, 451/539
See application file for complete search history.

(56) References Cited

U.S. PATENT DOCUMENTS

| | | | |
|---|---|---|---|
| 2,866,991 | A | 1/1959 | Chao |
| 3,021,649 | A | 2/1962 | Robbins |
| 4,361,934 | A | 12/1982 | Darnell |
| 4,592,148 | A | 6/1986 | Longenette |
| 4,714,644 | A | 12/1987 | Rich |
| 4,965,966 | A | 10/1990 | Braasch |
| 5,368,424 | A | 11/1994 | Bettenhausen |
| 5,489,233 | A | 2/1996 | Cook |
| 5,527,212 | A | 6/1996 | Bowen |

(Continued)

FOREIGN PATENT DOCUMENTS

EP 2653635 10/2013

OTHER PUBLICATIONS

ISA/US, International Search Report and Written Opinion of the International Searching Authority, Sep. 21, 2022.

(Continued)

*Primary Examiner* — Eileen P Morgan
(74) *Attorney, Agent, or Firm* — Mertzlufft Law PLLC; Joshua Mertzlufft

(57) ABSTRACT

Embodiments of sanding systems and methods for using and making the same may include providing a sanding system, comprising a body and a core. The body may be defined by at least a plurality of faces including a proximal face and a distal face and further defined by a hole extending lengthwise from the proximal face at least partially through the body toward the distal face. The core may be configured to be disposed at least partially within the hole such that changing an extent to which the core is disposed within the hole changes a density gradient of the sanding system.

7 Claims, 11 Drawing Sheets

(56) References Cited

U.S. PATENT DOCUMENTS

| | | | | |
|---|---|---|---|---|
| 6,454,428 | B1 | 9/2002 | Bruzon | |
| 6,544,113 | B1 | 4/2003 | Wheeler | |
| D480,619 | S | 10/2003 | Koenig, Jr. | |
| 6,662,521 | B1 | 12/2003 | Escobedo | |
| D501,857 | S | 2/2005 | Ebisawa | |
| 6,896,606 | B1 | 5/2005 | Turgeon | |
| 7,048,618 | B1 * | 5/2006 | Cramer | B24D 15/023 451/525 |
| 7,169,029 | B2 | 1/2007 | Petersen | |
| 7,320,634 | B1 | 1/2008 | Minick | |
| 7,364,501 | B2 | 4/2008 | Ali | |
| D625,063 | S | 10/2010 | Armaly, Jr. | |
| 7,901,275 | B2 | 3/2011 | Brogden | |
| 7,914,167 | B2 | 3/2011 | Petersen | |
| 10,420,449 | B2 | 9/2019 | Park | |
| 10,448,799 | B2 | 10/2019 | Klimis | |
| D902,000 | S | 11/2020 | Coughenour, Jr. | |
| 10,875,154 | B2 | 12/2020 | Dow | |
| D913,071 | S | 3/2021 | Stasko | |
| D926,001 | S | 7/2021 | Jacques | |
| 11,154,959 | B2 | 10/2021 | Lehuu | |
| 2002/0131267 | A1 | 9/2002 | Van Osenbruggen | |
| 2003/0224708 | A1 | 12/2003 | Koenig, Jr. | |
| 2004/0259488 | A1 | 12/2004 | McArthur | |
| 2007/0099551 | A1 | 5/2007 | Walsh | |
| 2007/0139916 | A1 | 6/2007 | Vermillion | |
| 2007/0298698 | A1 | 12/2007 | Ali | |
| 2008/0311831 | A1 | 12/2008 | Milbourne | |
| 2008/0311832 | A1 | 12/2008 | King | |
| 2008/0311833 | A1 | 12/2008 | King | |
| 2009/0065538 | A1 | 3/2009 | Rodriquez | |
| 2015/0055363 | A1 | 2/2015 | Van Straten | |
| 2016/0010849 | A1 | 1/2016 | Snellenberger | |
| 2016/0271458 | A1 | 9/2016 | Lin | |
| 2017/0066105 | A1 | 3/2017 | Grayden | |
| 2019/0210193 | A1 | 7/2019 | Belanger | |
| 2021/0199281 | A1 | 7/2021 | Creeley | |
| 2021/0370476 | A1 * | 12/2021 | James | B24D 15/04 |
| 2024/0001512 | A1 * | 1/2024 | Jenkins | B24D 18/0009 |

OTHER PUBLICATIONS

Uneeda, Uneeda Sponge (accessed May 16, 2022), https://www.zoro.com/uneeda-ekasilk-plus-12-in-sponge-3-x-4-x-4-hv-fine-p-105601/i/G100420255/.

Harbor Freight, Warrior Aluminum Oxide Sanding Sponges—Fine Grade, 10 Pack (Accessed Jul. 13, 2023), https://www.harborfreight.com/aluminum-oxide-sanding-sponges-fine-grade-10-pack-63912.html.

* cited by examiner

FLEXIBLE DENSITY SANDING SYSTEM

CROSS REFERENCE TO RELATED APPLICATIONS

This application is a U.S. national stage application of PCT/US22/73299, filed 30 Jun. 2022, which claims priority to U.S. Provisional Application No. 63/217,510, filed on 1 Jul. 2021, the entire disclosures of which are hereby incorporated by reference.

BACKGROUND

Sanders may include manual or power tools used to smooth a work surface, such as a drywall, wooden surface, or flooring, including woods and plastics. Sanders may also be used to remove small amounts of material from the work surface. Sanders may use sandpaper or the like to smooth surfaces by abrasion. Sanders may operate under application of a pressing force onto the work surface during sanding.

SUMMARY

This Summary is intended to introduce, in an abbreviated form, various topics to be elaborated upon below in the Detailed Description. This Summary is not intended to identify key or essential aspects of the claimed invention. This Summary is similarly not intended for use as an aid in determining the scope of the claims.

An implementation may include a sanding system. The sanding system may include a body and a core. The body may be defined by at least a plurality of faces including a proximal face and a distal face, and a hole extending lengthwise from the proximal face at least partially through the body toward the distal face. The core may be configured to be disposed at least partially within the hole such that changing an extent to which the core may be disposed within the hole may change a density gradient of the sanding system.

A further implementation may include a method of using a sanding system. The method may include providing the sanding system. The sanding system may include a body and a core. The body may be defined by at least a plurality of faces including a proximal face and a distal face, and a hole extending lengthwise from the proximal face at least partially through the body toward the distal face. The core may be configured to be disposed at least partially within the hole such that changing an extent to which the core may be disposed within the hole may change a density gradient of the sanding system. The method may further include changing the extent to which the core may be disposed within the hole, which may change the density gradient of the sanding system.

A further implementation may include a sanding system. The sanding system may include a body and a core. The body may be defined by at least a plurality of faces composing a parallelepiped, the plurality of faces including a proximal face and a distal face substantially parallel to the proximal face, a hole extending lengthwise from the proximal face at least partially through the body toward the distal face. At least one corner or edge of the body may be oblique. At least one of the plurality of faces may have an abrasive grit disposed thereon. The core may be configured to be disposed at least partially within the hole such that changing an extent to which the core may be disposed within the hole may change a density gradient of the sanding system. The core and the body may be monolithic. The core and the body may be connected via a ligament coterminous with distal face. The core and the body may be configured such that a ligament rending force applied to the distal face coaxial to a longitudinal axis of the core may rend the ligament, which may lead to separating the core from the body such that the core may be removable from the body.

A further implementation may include a method of making a sanding system. The method may include providing a body, forming a hole, and forming a core. The body may be defined by at least a plurality of faces including a proximal face and a distal face. The hole may extend lengthwise from the proximal face at least partially through the body toward the distal face. The core may be configured to be disposed at least partially within the hole such that changing an extent to which the core may be disposed within the hole may change a density gradient of the sanding system.

BRIEF DESCRIPTION OF THE FIGURES

For a fuller understanding of the nature and objects of the disclosure, reference should be made to the following detailed description taken in conjunction with the accompanying drawings, in which.

DETAILED DESCRIPTION

Figure 1A:
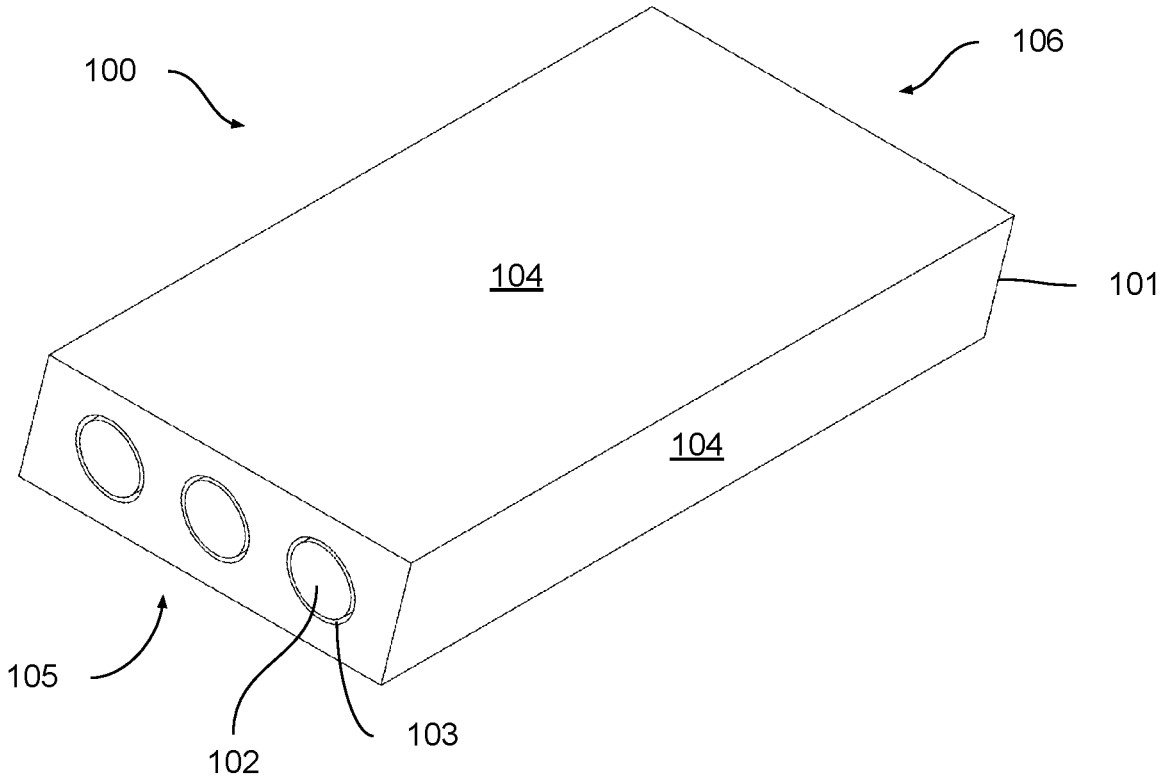
FIG. 1A illustrates a sanding system, according to an embodiment.

It is to be understood that the invention is not limited in its application to the details of construction and the arrangements of components and/or method steps set forth in the following description or illustrated in the drawings, and phraseology and terminology used herein is for the purpose of description and should not be regarded as limiting. The invention is capable of other embodiments and of being practiced or being carried out in various ways. Accordingly, other aspects, advantages, and modifications will be apparent to those skilled in the art to which the invention pertains, and these aspects and modifications are within the scope of the invention, which is limited only by the appended claims.

Sanding with a sanding sponge may involve applying pressure to different faces and edges of the sanding sponge for smoothing or polishing a surface. Sanding may be a process used to treat a work surface for different purposes, including to smooth the surface, to remove flaws or adhered foreign matter from the surface, or to roughen the surface in preparation for a further treatment such as coating or painting.

Conventional sanding systems may not sufficiently improve a user's fine control over a density of the sanding sponge itself. Such lack of control may require a user to use a variety of sanding sponges and techniques to accomplish desired sanding results. Such an approach can be costly and time consuming.

Embodiments disclosed herein include sanding systems and methods for using and making the same. A sanding system may include a body and a core. The body may be defined by a least a plurality of faces including a proximal face and a distal face. The body may be further defined by a hole extending lengthwise from the proximal face at least partially through the body toward the distal face. The core may be configured to be disposed at least partially within the hole such that changing an extent to which the core is disposed within the hole may change a density gradient of the sanding system.

A density gradient may refer to a three-dimensional gradient of density through the volume enclosed by the faces of the sanding system. A density gradient may be increased, locally or overall, by adjusting a density of at least a portion of the sanding system. A density gradient may be decreased, locally or overall, by adjusting a density of at least a portion of the sanding system. A density of at least a portion of the sanding system may be effected by removing, inserting, or changing an insertion extent of a core within a hole defining a body of the sanding system.

Further embodiments may include methods of using a sanding system. Such methods may include providing the sanding system. The sanding system may include a body and a core. The body may be defined by at least a plurality of faces including a proximal face and a distal face, and a hole extending lengthwise from the proximal face at least partially through the body toward the distal face. The core may be configured to be disposed at least partially within the hole such that changing an extent to which the core may be disposed within the hole may change a density gradient of the sanding system. Such methods may further include changing the extent to which the core may be disposed within the hole, which may change the density gradient of the sanding system.

Further embodiments may include sanding systems. The sanding system may include a body and a core. The body may be defined by at least a plurality of faces composing a parallelepiped, the plurality of faces including a proximal face and a distal face substantially parallel to the proximal face, a hole extending lengthwise from the proximal face at least partially through the body toward the distal face. At least one corner or edge of the body may be oblique. At least one of the plurality of faces may have an abrasive grit disposed thereon. The core may be configured to be disposed at least partially within the hole such that changing an extent to which the core may be disposed within the hole may change a density gradient of the sanding system. The core and the body may be monolithic. The core and the body may be connected via a ligament coterminous with distal face. The core and the body may be configured such that a ligament rending force applied to the distal face coaxial to a longitudinal axis of the core may rend the ligament, which may lead to separating the core from the body such that the core may be removable from the body.

Further embodiments may include methods of making sanding systems. Such methods may include providing a body, forming a hole in the body, and forming a core. The body may be defined by at least a plurality of faces including a proximal face and a distal face. The hole may extend lengthwise from the proximal face at least partially through the body toward the distal face. The core may be configured to be disposed at least partially within the hole such that changing an extent to which the core may be disposed within the hole may change a density gradient of the sanding system.

The plurality of faces may compose a parallelepiped, which may include a corner and an edge. The distal face may be substantially parallel to the proximal face. The corner may be, for example, orthogonal or oblique, filleted, or chamfered. The edge may be, for example, orthogonal, oblique, filleted, or chamfered.

At least one of the plurality of faces may have an abrasive grit disposed thereon or integrated therewith.

The hole may extend through the distal face. The hole may be a cored hole or a drilled hole. The core may be disposed within the hole.

The core and the body may be monolithic. The core and the body may be connected via a ligament coterminous with distal face.

The core, body, and ligament may be configured such that a ligament rending force applied to the distal face coaxial to a longitudinal axis of the core may rend the ligament, which may separate the core from the body such that the core may be removable from the body.

The core and the body may include a homogeneous material. The core may include a polymer, metal, light device, or marking device.

Changing the extent to which the core may be disposed within the hole may include inserting the core into the hole from without the hole. Changing the extent to which the core may be disposed within the hole may include removing the core from within hole to without the hole. Changing the extent to which the core may be disposed within the hole may include adjusting the core from a first insertion extent within the hole to a second insertion extent within the hole.

Forming the hole and forming the core may include coring the hole such that, after coring the core, the body may be monolithic. The core and the body may be connected via a ligament coterminous with distal face.

Forming the hole may include drilling the hole, coring the hole, cutting the hole, or drilling the hole. Forming the hole may include using a coring bit, a drill bit, a blade, a laser, or a water jet.

Providing the body, forming the hole, and forming the core may include injecting a formable material into a mold configured to mold the body defined by the plurality of faces and the hole and, in some embodiments, the core.

Embodiments herein may provide easy-to-operate, inexpensive, tools-free variable flexibility sanding systems having integrated grit, so as to enable more flexible sanding capacity, and greater sanding precision, which may affect work surface smoothness.

Maintaining or increasing density of a sanding system (e.g., by maintaining presence of a core within the sanding system or by replacing the core with a higher density core), may optimize the sanding system for performing coarser sanding work. This may be contrasted with decreasing a density gradient of a sanding system (e.g., removing a core or replacing the core with a lower density core), which may optimize the sanding system for performing finer sanding work. Cores may be selectably or alternately removed, left in, or inserted, or may be removed or inserted partially, to effect a desired density gradient of the sanding system. For example, a user may configure a sanding system to have a higher-density (e.g., more rigid) portion and a lower-density (e.g., less rigid) portion.

FIG. 1A illustrates a sanding system 100, according to an embodiment. Sanding system 100 may provide for an ability to perform abrasion upon a surface, for example, drywall, wood, metal, or painted surfaces. Sanding system 100 may enable a user to adjust a density gradient of sanding system 100 to effect a change in a rigidity (e.g., conversely, a flexibility) of sanding system 100.

Sanding system 100 may include a body 101 and one or more cores 102. Cores 102 may be of the same or different material from body 101, which may comprise, for example, a sponge material. In some embodiments, cores 102 may be of a different material than body 101. Each core 102 may be disposed at least partially within a hole 103 (e.g., a channel), each of which in part defines body 101. Hole(s) 103 may extend lengthwise from a proximal face 105 of sanding system 100 at least partially through the body toward a distal face 106 of sanding system 100. Each core 102 may be disposed at least partially within a respective hole 103 such that changing an extent to which core 102 is disposed within its respective hole 103 may change a density gradient of sanding system 100. Body 101 may be of a variety of shapes, and may be defined by one or more faces 104. Faces 104 may include proximal face 105 and distal face 106. Body 101 may be further defined by hole(s) 103 such that cavities are present within body 101.

While FIG. 1A illustrates holes 103, which may define body 101 in part, as substantially circular in profile, parallel, and three in a quantity, it will be understood that there may be varying quantities, positions, or orientations of holes 103 or various shapes of holes 103 (e.g., substantially square, polygonal, elliptical, oval, rectangular, star-shaped, or irregular in profile). There may be a ligament of body 101 separating each hole 103, or the holes 103 may coincide.

Faces 104 of body 101 may be arranged to form a variety of shapes, for example, a parallelepiped. In other embodiments, faces 104 may be arranged to form, for example, a rectangular prism or other three-dimensional shape. One or more of faces 104 may include a grit disposed thereon or integrated therewith to provide for an abrasive characteristic of sanding system 100 when applied to a work surface (e.g., drywall, wood, fiberglass, or other malleable material having a flat or contoured surface). In a non-limiting example, the grit may be rated from coarse to ultra fine. In some embodiments, faces 104 of sanding system 100 may include varying grits (e.g., by face or over a given face). One or more of faces 104 may be free from grit.

Figure 1B:
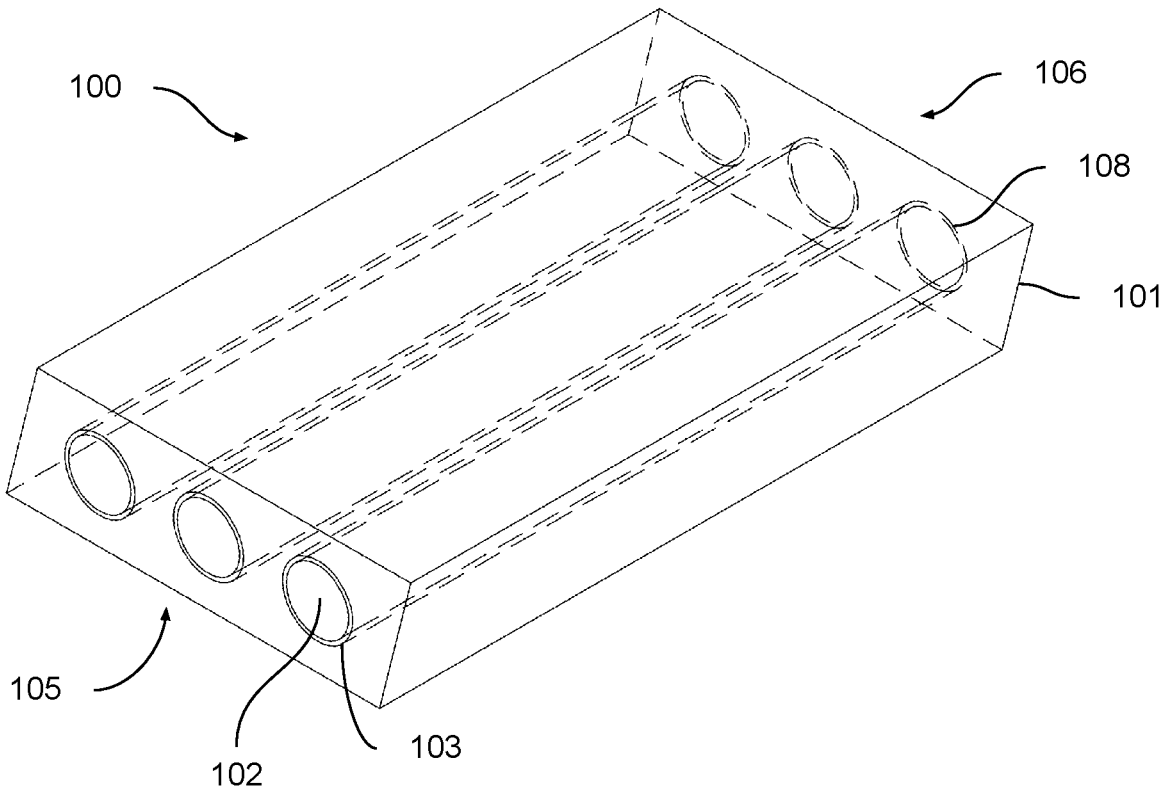
FIG. 1B illustrates a hidden-lines view of the sanding system, according to an embodiment.

FIG. 1B illustrates a hidden-lines view of the sanding system 100, according to an embodiment. FIG. 1B may illustrate hole(s) 103 extending into body 101. In some embodiments, hole(s) 103 may extend fully through body 101 (e.g., through distal face 106 and proximal face 105). In yet other embodiments hole(s) 103 may extend partially through body 101 (e.g., through proximal face 105, but not through distal face 106). In yet other embodiments, one or more of hole(s) 103 may extend alternately through either or both of proximal face 105 or distal face 106. FIG. 1B may further illustrate cores 102 disposed within their respective hole(s) 103. Where cores 102 are integral (e.g., monolithic) with body 101, a ligament 108 may connect each core 102 to the remainder of body 101. A user may rend ligament 108 to remove a given core 102 from its respective hole 103.

Figure 1C:
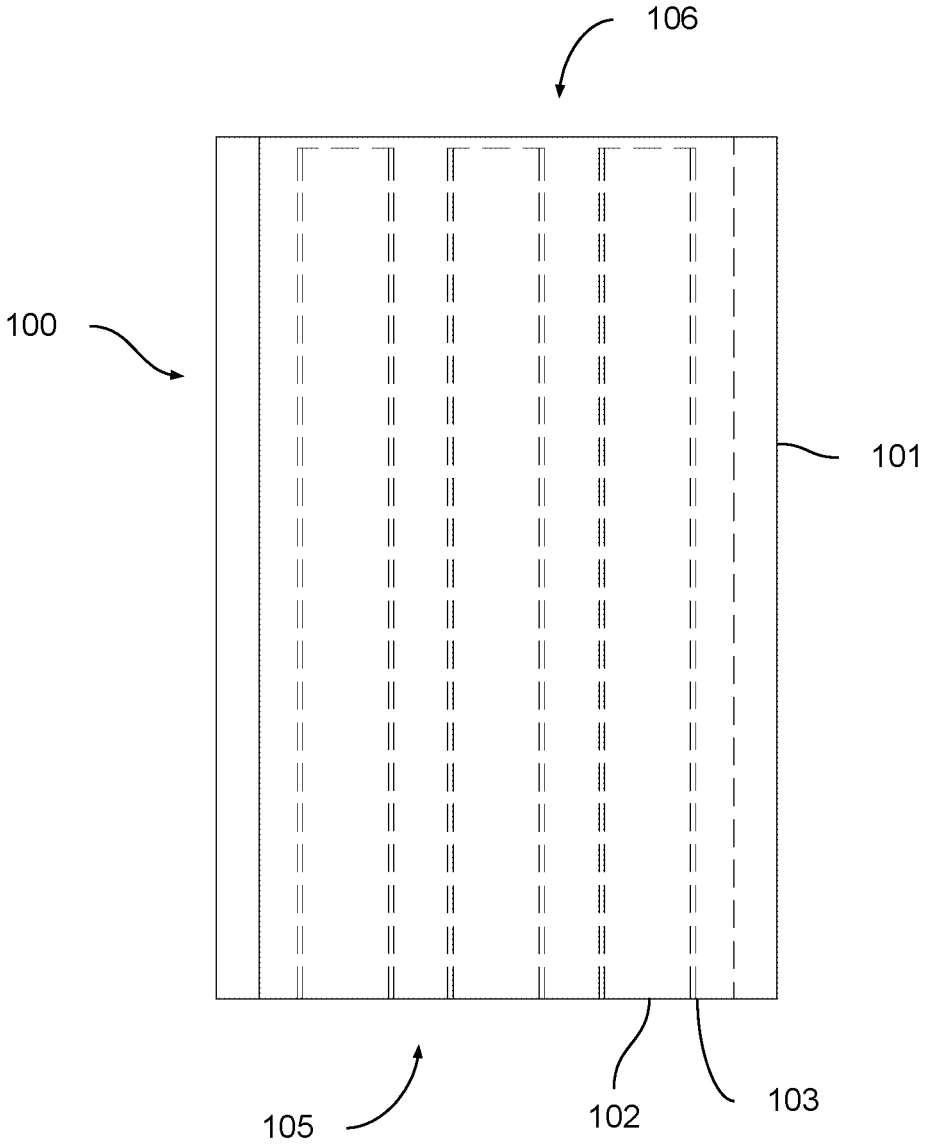
FIG. 1C illustrates a top view of the sanding system, according to an embodiment.

FIG. 1C illustrates a top view of the sanding system 100, according to an embodiment. FIG. 1C may illustrate an embodiment in which hole(s) 103 extend through proximal face 105 but not through distal face 106.

Figure 1D:
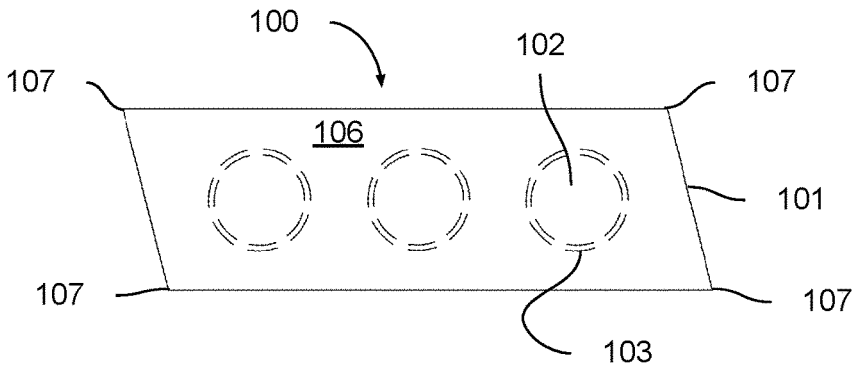
FIG. 1D illustrates a rear view of the sanding system, according to an embodiment.

FIG. 1D illustrates a rear view of the sanding system 100, according to an embodiment. FIG. 1D may illustrate locations of hole(s) 103 using hidden lines as viewed from the distal face 106.

It will be understood that the corners or edges of sanding system 100 may be oblique or orthogonal, which may be based on the shape defined by faces 104. For example, FIG. 1D illustrates corners 107, which are oblique. It will be further understood that various of the corners or edges may be filleted or chamfered, or otherwise having a local geometry based on a variety of factors, including, for example, workability, usability, ergonomics, or other design factors.

Figure 1E:
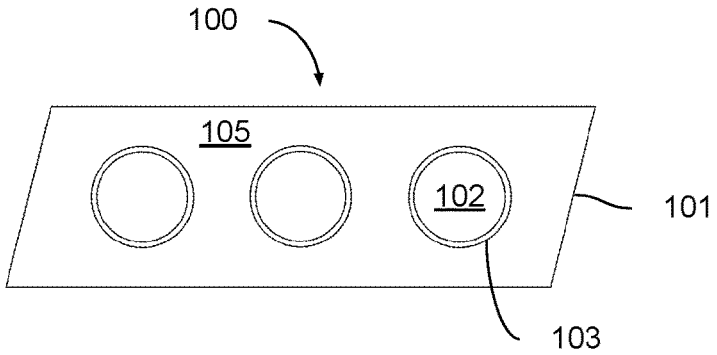
FIG. 1E illustrates a front view of the sanding system, according to an embodiment.

FIG. 1E illustrates a front view of the sanding system 100, according to an embodiment. FIG. 1E may illustrate locations of hole(s) 103 as viewed from the proximal face 105.

Figure 1F:
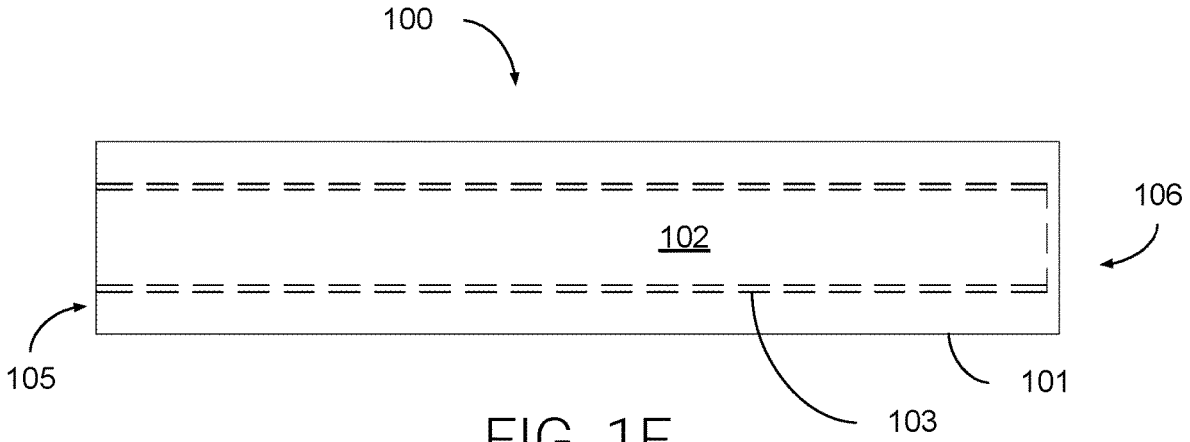
FIG. 1F illustrates a side view of the sanding system, according to an embodiment.

FIG. 1F illustrates a side view of the sanding system 100, according to an embodiment. FIG. 1F may illustrate an embodiment hole 103 extending through proximal face 105 of body 101 but not through distal face 106 of body 101.

Figure 2:
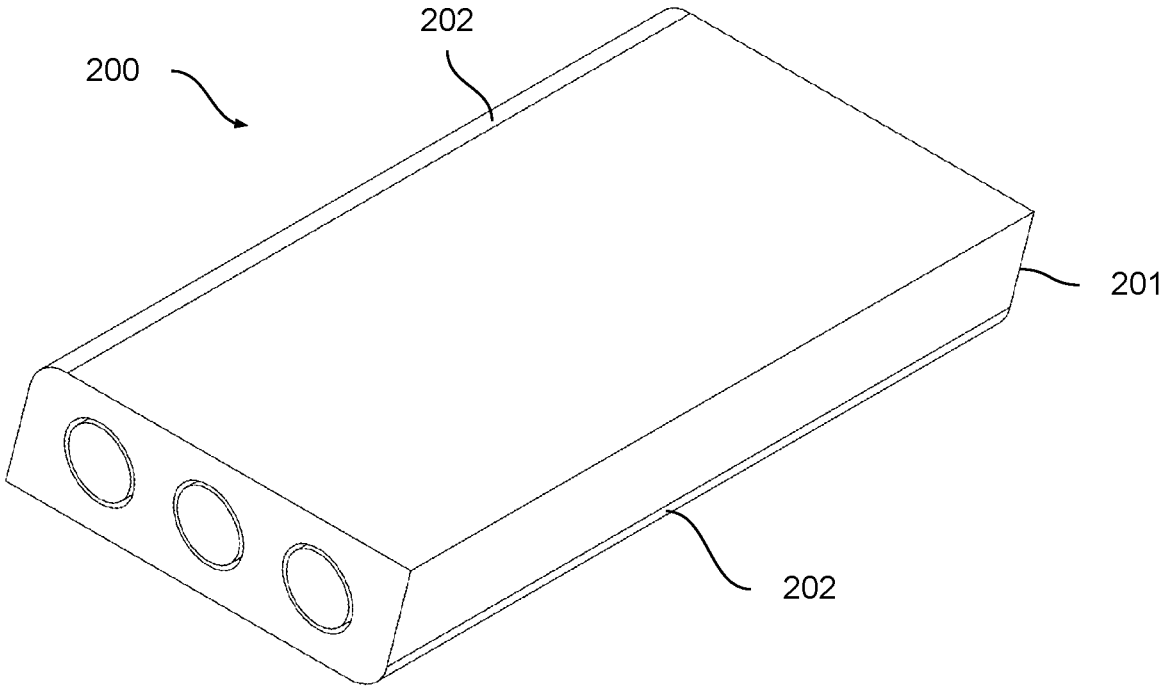
FIG. 2 illustrates a further embodiment of a sanding system, according to an embodiment.

FIG. 2 illustrates a further embodiment of a sanding system 200, according to an embodiment. Sanding system 200 may be similar to sanding system 100, however, one or more edges 202 of body 201 may have a local geometry, for example, a fillet or chamfer. Such local geometry may improve ergonomics or application of sanding system 200 in certain embodiments.

FIGS. 3A-3D may illustrate a variety of configurations of sanding system 100. Each figure may illustrate a different configuration of cores selectively inserted or removed from their respective hole(s) of body 101.

Figure 3A:
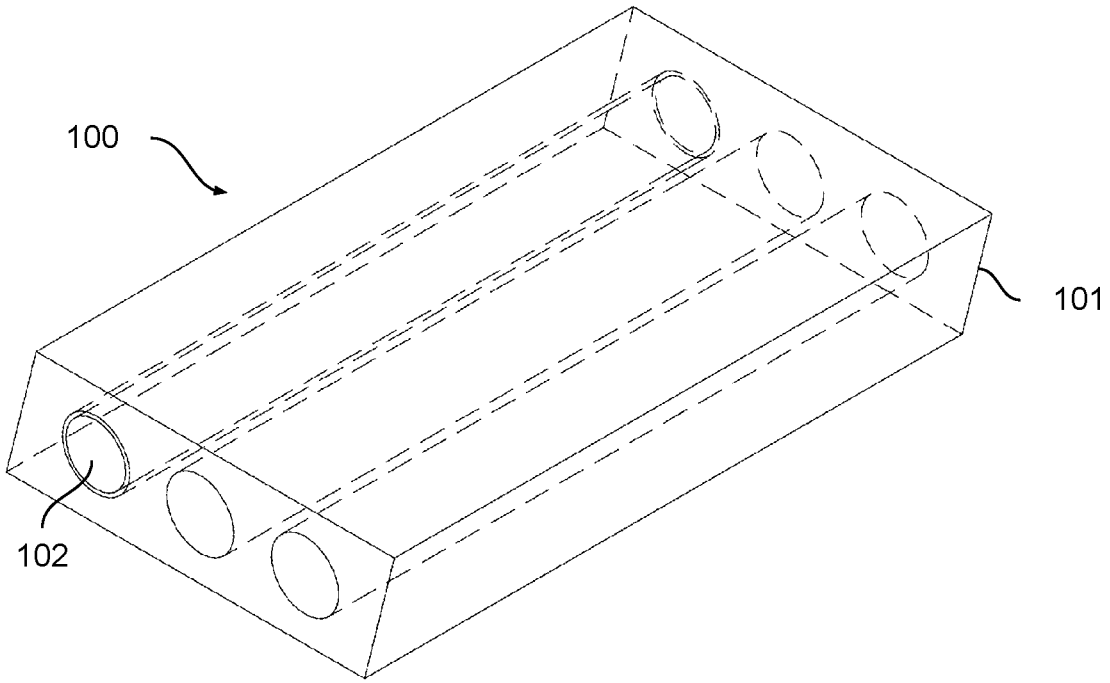
FIG. 3A illustrates a sanding system configured with a plurality of cores removed, according to an embodiment.
Figure 3B:
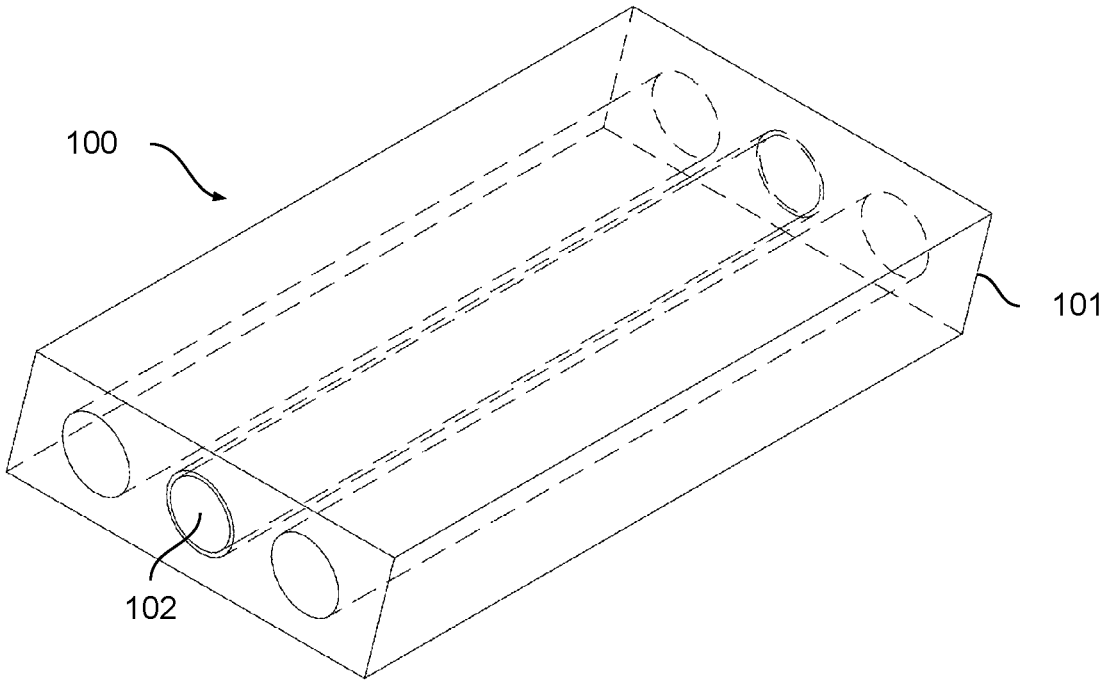
FIG. 3B illustrates a sanding system configured with a plurality of cores removed, according to an embodiment.
Figure 3C:
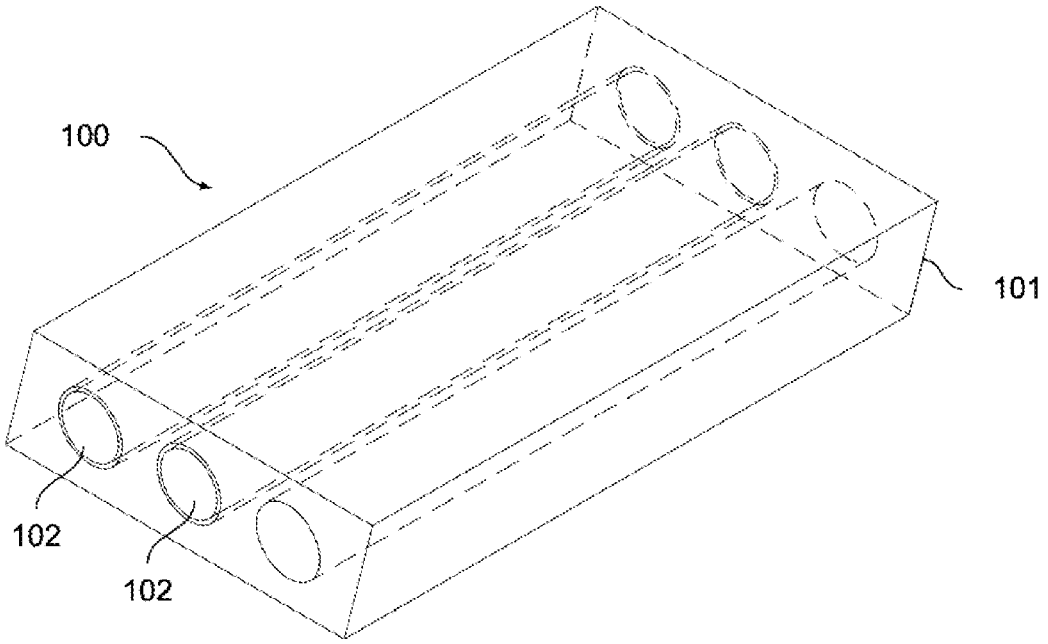
FIG. 3C illustrates a sanding system configured with a plurality of cores not removed, according to an embodiment.
Figure 3D:
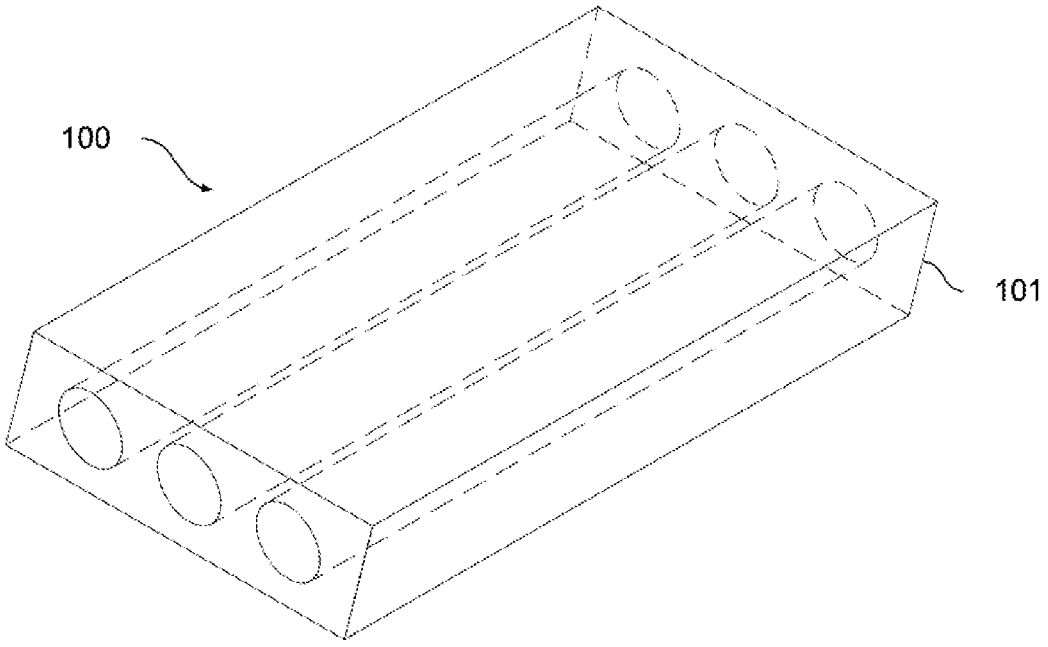
FIG. 3D illustrates a sanding system configured with all cores removed, according to an embodiment.

FIG. 3A illustrates sanding system 100 configured with a plurality of cores removed and a core 102 remaining inserted, according to an embodiment. FIG. 3B illustrates sanding system 100 configured with a plurality of cores removed and a core 102 remaining inserted, according to an embodiment. FIG. 3C illustrates sanding system 100 configured with a plurality of cores 102 not removed and a plurality of cores 102 remaining inserted, according to an embodiment. FIG. 3D illustrates sanding system 100 configured with all cores removed, according to an embodiment.

Figure 4A:
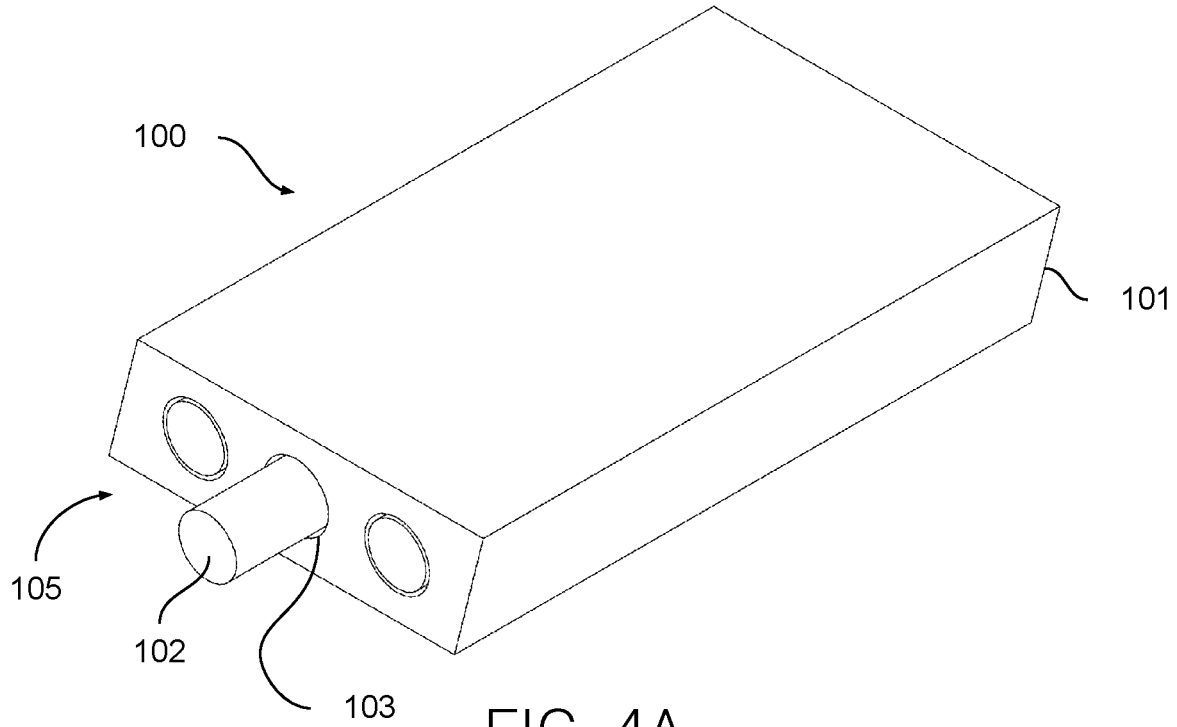
FIG. 4A illustrates a sanding system configured with a core partially removed, according to an embodiment.
Figure 4B:
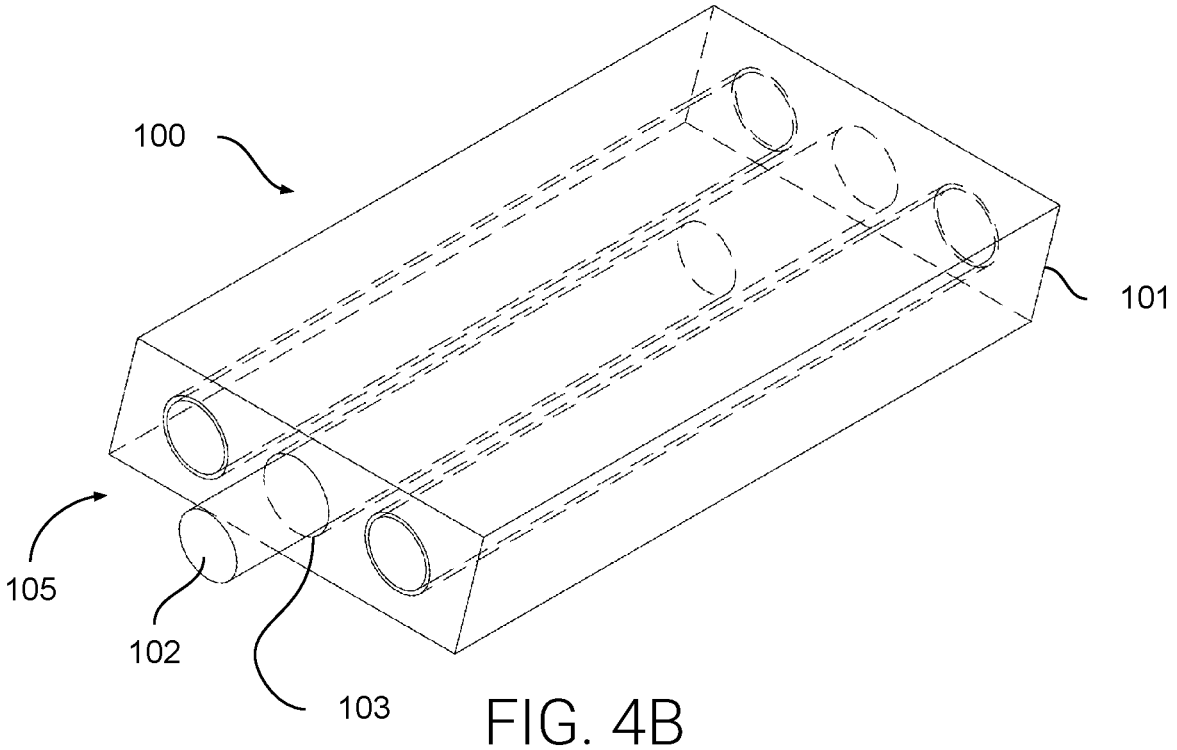
FIG. 4B illustrates a hidden-lines view of the sanding system configured with the core partially removed, according to an embodiment.

It will be understood that cores 102 need not be limited to either being fully inserted within a respective hole 103 or fully removed from a respective hole 103. For example, a core 102 may be partially inserted into or removed from a respective hole 103. FIG. 4A illustrates sanding system 100 configured with a core 102 partially removed, according to an embodiment. FIG. 4B illustrates a hidden-lines view of sanding system 100 configured with core 102 partially removed, according to an embodiment.

Where cores 102 are integral with body 101, cores 102 may comprise the same material as body 101. However, cores 102 need not be the same material as body 101. For example, a core 102 may comprise a material having the same or different density as body 101, such that inserting such a core may provide a user further control over the density gradient of sanding system 100.

In an example, sanding system 100 may initially have a core integral therewith and it may be desirable for a user of sanding system 100 to decrease a density gradient of sanding system 100. To do so, the user may remove the integral core (e.g., by rending a ligament connecting it to the body) from sanding system 100. A user may then desire to increase a density gradient of sanding system 100 and may then reinsert the previously integral core.

In a further example, a user may desire to modify a density gradient of sanding system 100 to a density greater than that of sanding system 100 with an integral core integral therewith. To effect this, a user may replace an integral core with a core of a different material, for example, the user may replace a core comprising the sponge material with, for example, a plastic, metal, wooden, or other material core depending on the desired density gradient.

A user may use different cores of the same or different materials within the same sanding system 100, with, for example, some cores being of the original sponge material, some cores being removed entirely such that the hole is empty, and/or some cores being replaced with a core of a different material. For example, a sanding system 100 may be configured such that one integral core is retained, one hole is empty, and yet another hole has a core comprising a material differing in density from the sponge material.

Figure 5A:
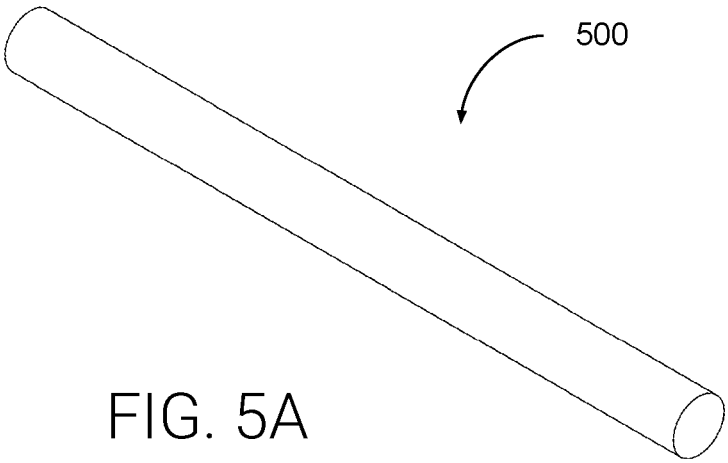
FIG. 5A illustrates a core, according to an embodiment.
Figure 5B:
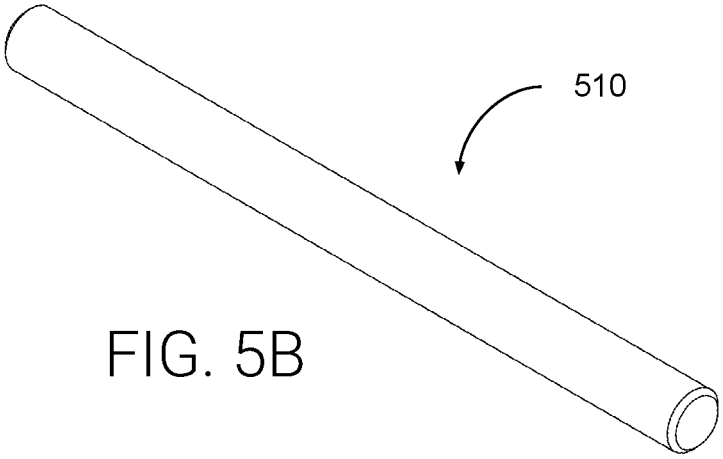
FIG. 5B illustrates a core having a chamfered end, according to an embodiment.

FIG. 5A illustrates a core 500, according to an embodiment. Core 500 may, for example, have a geometry as produced from the production of the sanding system. In this example, core 500 may have cornered (e.g., not chamfered or filleted) edges. In other embodiments, the edges of the core may have local geometry such as, for example, a chamfer or a fillet. FIG. 5B illustrates a core 510 having a chamfered end, according to an embodiment.

Figure 5C:
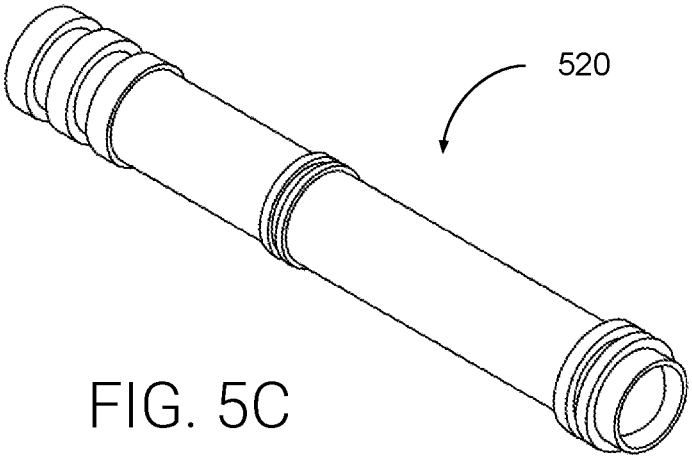
FIG. 5C illustrates a core comprising an light device, according to an embodiment.

In yet other embodiments, a tool or device may be placed within a hole in lieu of a core. For example, a light device, a marking device, or another tool or device which may be used with sanding system 100 may be inserted at least partially into a hole. Such a light device may enable a user to provide light to a workspace by operating the light device. A marking device may provide for a user to mark lines using the sanding system. FIG. 5C illustrates a core 520 comprising a light device, according to an embodiment.

Figure 6:
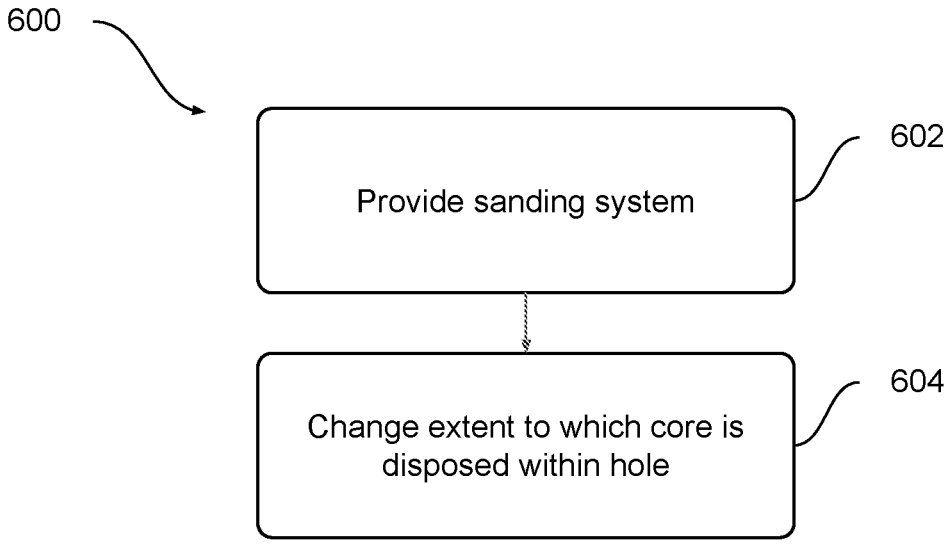
FIG. 6 illustrates a method of using a sanding system, according to an embodiment.

FIG. 6 illustrates a method 600 of using a sanding system, according to an embodiment. Method 600 may provide for a user to be able to adjust a density gradient of a sanding system as desired by the user based on, for example, work piece requirements.

At 602, a sanding system may be provided. The sanding system may include a body and a core. The body may be defined by at least a plurality of faces including a proximal face and a distal face. The body may be further defined by a hole, which may extend lengthwise from the proximal face at least partially through the body toward the distal face. The core may be configured to be disposed at least partially within the hole. The core may be disposed within the hole such that changing an extent to which the core is disposed within the hole may change a density gradient of the sanding system.

At 604, an extent to which the core is disposed within hole may be changed. By changing the extent to which the core is disposed within the hole the density gradient within the sanding system may be changed. Changing the extent to which the core is disposed within the hole may include removing at least partially the core from within the hole or inserting the core at least partially into the hole from without the hole. The core may be adjusted within the hole or fully removed or fully inserted into or out of the hole. Changing the extent to which the core is disposed within the hole may include adjusting the core from a first insertion extent within the hole to a second insertion extent within the hole.

Prior to a change of extent to which the core is disposed within the hole, the core may be integral with the body such that the core and the body are monolithic. In this way, the core and the body may be connected via a ligament, which may be coterminous with the distal face. The core, body, and ligament may be configured such that a ligament rending force applied to the distal face substantially coaxial to a longitudinal axis of the core may rend the ligament. By applying such a rending force and rending the ligament, the core may be separated from the body such that the core becomes removable from the body. When integral, the core and the body may comprise a homogenous material.

Figure 7:
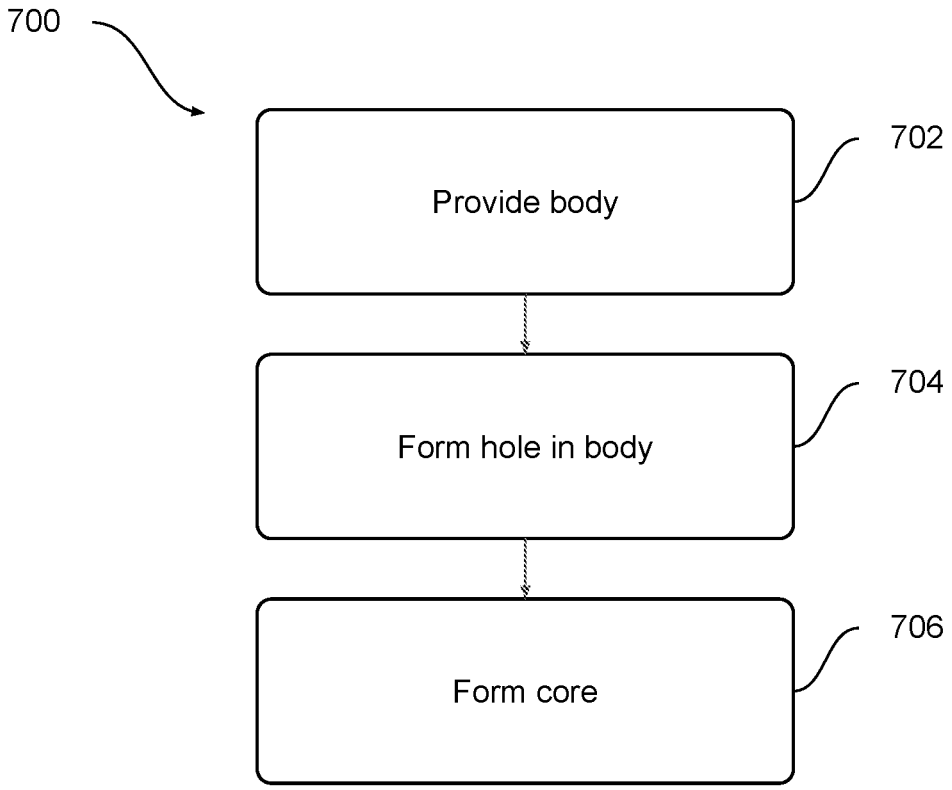
FIG. 7 illustrates a method of making a sanding system, according to an embodiment.

FIG. 7 illustrates a method 700 of making a sanding system, according to an embodiment.

At 702, a body may be provided. The body may be defined by at least a plurality of faces, which may include a proximal face and a distal face.

At 704, a hole may be formed in the body. The hole may extend lengthwise from the proximal face at least partially through the body through the distal face. Forming the hole may include embodiments of various manufacturing processes, for example, drilling, cutting, coring, or other methods. If cut, the hole may be cut using, for example, a blade, a laser, or a water jet.

At 706, a core may be formed. The core may be configured to be disposed at least partially within the hole such that changing an extent to which the core is disposed within the hole may change the density gradient of the sanding system. It will be understood that the hole and core may be formed simultaneously in the case of certain embodiments of manufacturing processes. In this way forming the hole and forming the core may be effected, for example, by coring the hole such that after coring, the core and the body are monolithic and the core and the body are connected via a ligament coterminous with the distal face.

It will be understood that in some embodiments of method 700, providing the body at 702, forming the hole at 704, and forming the core at 706, may comprise injecting a formable material into a mold configured to mold the body defined by the plurality of faces, the hole, and the core (e.g., using injection molding techniques).

Various characteristics, advantages, embodiments, and/or examples relating to the invention have been described in the foregoing description with reference to the accompanying drawings. However, the above description and drawings are illustrative only. The invention is not limited to the illustrated embodiments and/or examples, and all embodiments and/or examples of the invention need not necessarily achieve every advantage or purpose, or possess every characteristic, identified herein. Accordingly, various changes, modifications, or omissions may be effected by one skilled in the art without departing from the scope or spirit of the invention, which is limited only by the appended claims. Although example materials and dimensions have been provided, the invention is not limited to such materials or dimensions unless specifically required by the language of a claim. Elements and uses of the above-described embodiments and/or examples can be rearranged and combined in manners other than specifically described above, with any and all permutations within the scope of the invention, as limited only by the appended claims.

In the claims, various portions are prefaced with letter or number references for convenience. However, use of such references does not imply a temporal or ordered relationship not otherwise required by the language of the claims. Unless the phrase 'means for' or 'step for' appears in a particular claim or claim limitation, such claim or claim limitation should not be interpreted to invoke 35 U.S.C. § 112(f).

As used in the specification and in the claims, use of "and" to join elements in a list forms a group of all elements of the list. For example, a list described as comprising A, B, and C defines a list that includes A, includes B, and includes C. As used in the specification and in the claims, use of "or" to join elements in a list forms a group of at least one element of the list. For example, a list described as comprising A, B, or C defines a list that may include A, may include B, may include C, may include any subset of A, B, and C, or may include A, B, and C. Unless otherwise stated, lists herein are inclusive, that is, lists are not limited to the stated elements and may be combined with other elements not specifically stated in a list. As used in the specification and in the claims, the singular form of 'a', 'an', and 'the' include plural referents (e.g., one or more of the referent) unless the context clearly dictates otherwise.

It is to be expressly understood that the drawings are for the purpose of illustration and description only and are not intended as a definition of the limits of the invention.

It is to be expressly understood that the drawings are for the purpose of illustration and description only and are not intended as a definition of the limits of the invention.

Unless otherwise stated, any range of values disclosed herein sets out a lower limit value and an upper limit value, and such ranges include all values and ranges between and including the limit values of the stated range, and all values and ranges substantially within the stated range as defined by the order of magnitude of the stated range.

The inventors hereby state their intent to rely on the Doctrine of Equivalents to determine and assess the reasonably fair scope of their invention as pertains to any apparatus not materially departing from but outside the literal scope of the invention as set out in the following claims.

I claim:

1. A sanding system, comprising:

a body defined by at least:

a plurality of faces composing a parallelepiped, the plurality of faces including a proximal face and a distal face substantially parallel to the proximal face; and a hole extending lengthwise from the proximal face at least partially through the body toward the distal face;

wherein:

at least one corner or edge of the body is oblique; and at least one of the plurality of faces has an abrasive grit disposed thereon; and a core configured to be disposed at least partially within the hole such that changing an extent to which the core is disposed within the hole changes a density gradient of the sanding system;

wherein:

the core and the body are monolithic;

the core and the body are connected via a ligament coterminous with distal face; and the core and the body are configured such that a ligament rending force applied to the distal face coaxial to a longitudinal axis of the core rends the ligament, thereby separating the core from the body such that the core is removable from the body.

2. The sanding system of claim 1, wherein the corner is orthogonal.

3. The sanding system of claim 1, wherein the corner is oblique.

4. The sanding system of claim 1, wherein the edge is orthogonal.

5. The sanding system of claim 1, wherein the edge is oblique.

6. The sanding system of claim 1, wherein the corner is filleted.

7. The sanding system of claim 1, wherein the edge is chamfered.

* * * * *